United States Patent [19]

Klar

[11] 3,969,873

[45] July 20, 1976

[54] MACHINE FOR MAKING BAG-LIKE TWO-COMPARTMENT PACKAGES PARTICULARLY TEA BAGS

[76] Inventor: Paul Gerhard Klar, Haus Seeblick, D-8992 Wasserburg, Germany

[22] Filed: Feb. 3, 1975

[21] Appl. No.: 546,697

[30] Foreign Application Priority Data

Feb. 7, 1974 Germany ..... 2405761

[52] U.S. Cl. ..... 53/134; 53/234

[51] Int. Cl.[2] ..... B65B 11/28; B65B 29/04

[58] Field of Search ..... 53/134, 183, 232, 233, 53/234

[56] References Cited

UNITED STATES PATENTS

| | | | |
|---|---|---|---|
| 2,913,860 | 11/1959 | Irmscher | 53/134 X |
| 3,774,369 | 11/1973 | Klar | 53/134 |
| 3,813,849 | 6/1974 | Stambera | 53/234 |

*Primary Examiner*—Othell M. Simpson
*Assistant Examiner*—John Sipos
*Attorney, Agent, or Firm*—McGlew and Tuttle

[57] ABSTRACT

Bag strips, filled with dosed portions of the substance to be packages, are fed continuously into the machine and the bags are formed solely by folding operations and closed by staples. A series of manufacturing units are continuously circulated along a conveyance path from a initial station, at which a thread-tag strand is fed to the machine and the bag strips are fed to the machine, past stations in which the bags are folded, erected, provided with a top closure, flattened and removed after separation from the strip. Each unit includes a common supporting frame mounting thereon, for conjoint movement along the conveyance path, all the unit devices for folding, closing and separating the bag from the strip, and including raising arms, one of which has a pocket for receiving a tag, a fold plate movable transversely to the bag strip and associated, for forming the bag bottom, with clamping holders movable opposite thereto, a device for cutting a tag thread, folders for forming the V-shaped top closure of the bag, a device for further folding and finishing the top closure and a device for fastening the thread to the bag top. Operating and control means mounted outside the conveyance path at stationary locations control the operation of all of the devices mounted on each common supporting frame.

12 Claims, 23 Drawing Figures

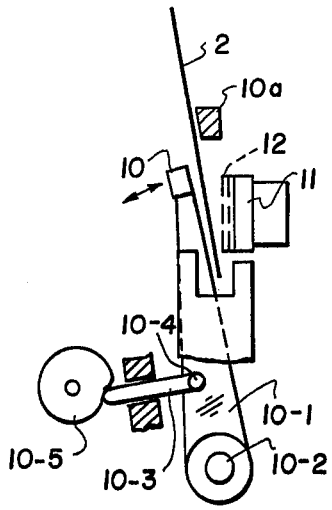
FIG. 2a
FIG. 4a
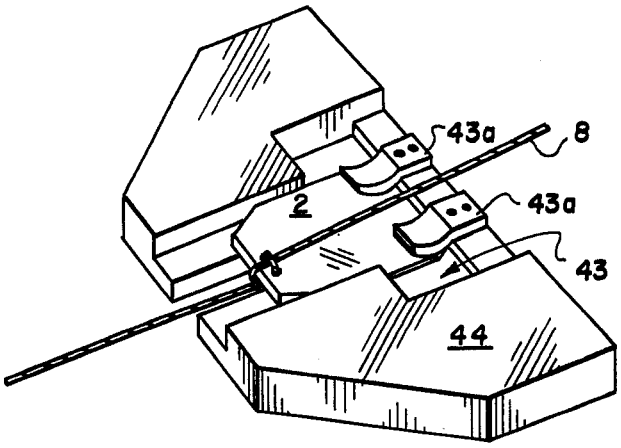
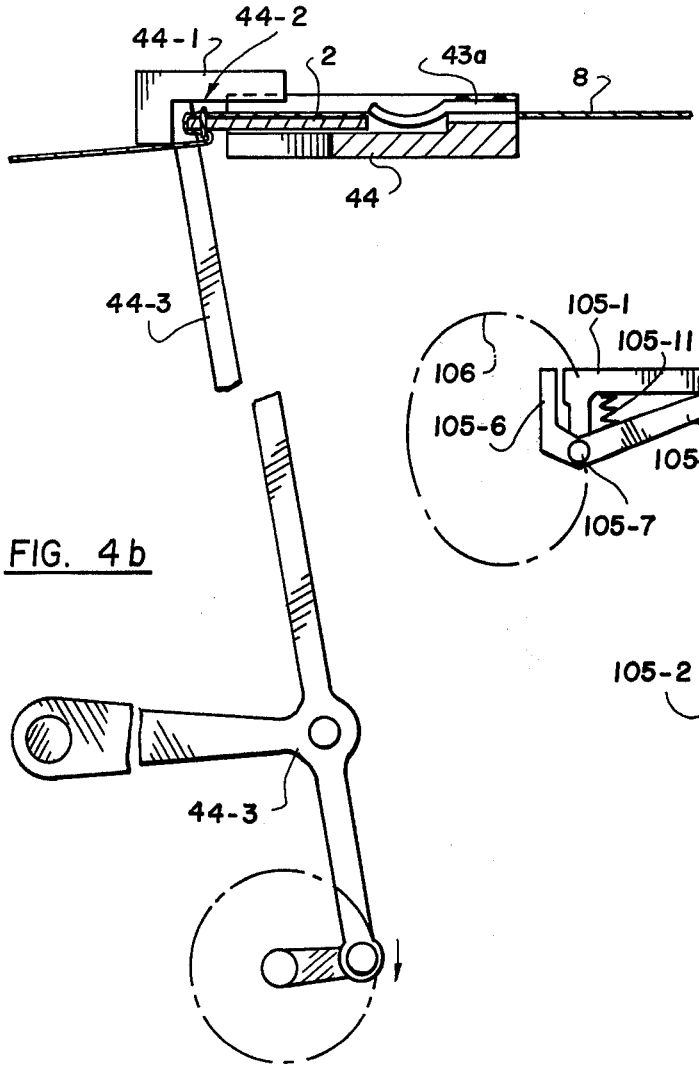
FIG. 4b
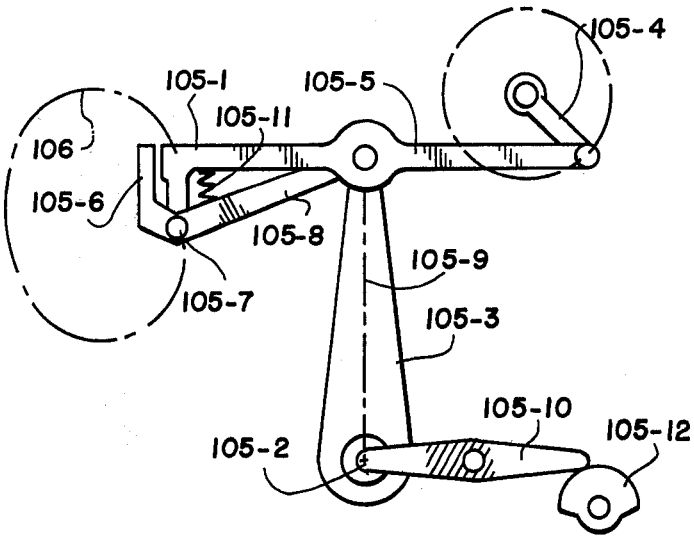
FIG. 16a

R
P
F

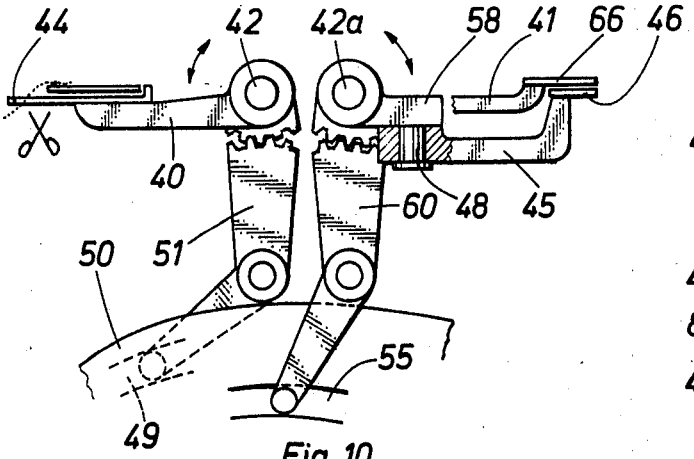
Fig. 10
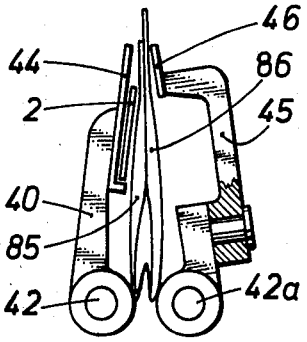
Fig. 11
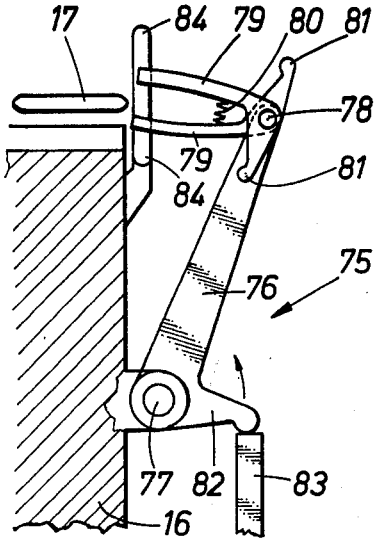
Fig. 12
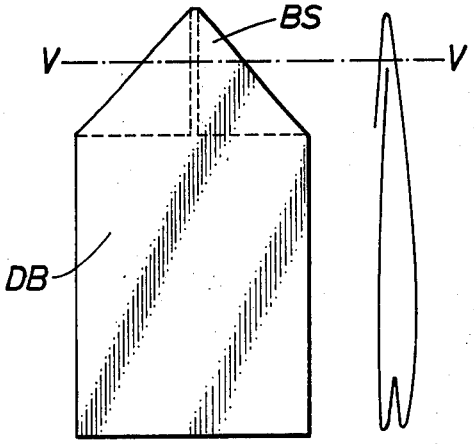
Fig. 13
Fig. 13a
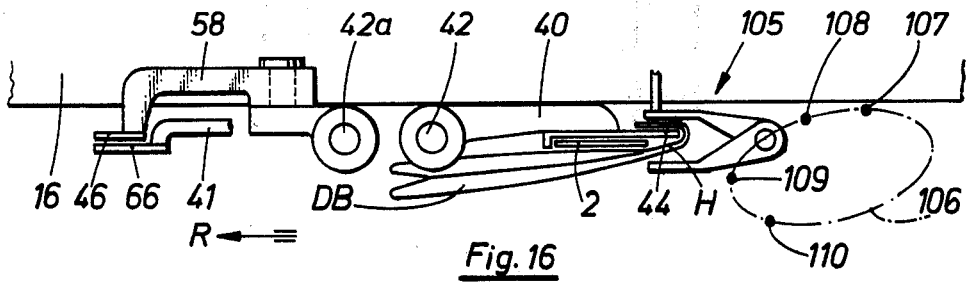
Fig. 16

MACHINE FOR MAKING BAG-LIKE TWO-COMPARTMENT PACKAGES PARTICULARLY TEA BAGS

FIELD AND BACKGROUND OF THE INVENTION

This invention relates to a machine for making bag-like two-compartment packages of a pliant material, particularly tea bags, each having a tag secured thereto by a thread, which are formed and closed exclusively by folding operations with the bag strip, filled with the substance to be packaged, being fed continuously to a machine comprising working units which are continuously circulated along a conveyance path and which working units are controlled by means disposed outside the conveyance path. Each unit comprises an assembly of folding members for forming the bag bottom, two raising arms for erecting the bag halves, and a receiving pocket in one raising arm for receiving the tag, the machine including a device for cutting the bag strip.

Such a machine, which has been disclosed, for example, in German Pat. No. 2,120,270, makes it possible to obtain a continuous output at a high working speed, even with tea bags which are formed and closed exclusively by folding, and where, consequently, the known means for manufacturing bags of a material capable of hot-sealing are no longer usable.

In this known machine, a part of the individual working devices are assembled into a unit and a plurality of such units are circulated, along with the workpiece, in sequence along an endless conveyance path. The other part of each individual device is partly mounted on an auxiliary conveyance means and moved along the main path in synchronism. The working operations are effected by members which are disposed outside the conveyance path.

With such measures, it is possible to achieve the desired continuity in the manufacture of tea bags of the kind in question. However, it has been found that the expenses of construction and the susceptibility to disturbances are still considerable, which is particularly due to the use of manufacturing devices moving along outside the conveyance path and to the necessary exact operational synchronism of these devices with the workpiece conveyed in the main path.

SUMMARY OF THE INVENTION

The present invention is directed to a development of the machine of the known design such as to obtain operational and constructional improvements leading particularly to an increase of the manufacturing capacity and, at the same time, to a further reduction of the need of attendance and susceptibility to disturbances.

In accordance with the invention, the machine of the type just mentioned is designed so that, in each of the manufacturing units, an assembly is mounted on a common supporting frame of the unit, and comprises as insertion pocket for the tag, carried by a raising arm, a folding plate movable transversely to the bag strip and cooperating with oppositely moved clamping holders to form the bottom of the bag, a device for cutting the thread, folders for forming the V-shaped closing top portion, a device for further folding and accomplishing the top closure, and a device for fastening the thread to the bag top, the operation of these devices being controllable, as before, through means mounted outside the path of conveyance.

The advantage of the invention arrangement resides primarily in the fact that, in contrast to the prior art, all of the individual devices, which are essential for the manufacture of the bag having a particular shape, are mounted on a common support as constituents of each of the manufacturing units circulating along the conveyance path, and that the operational control of these devices is effected by conventional means mounted outside this path. Consequently, the number of parts movable along the conveyance path of conveyance is reduced and the speed of circulation of this constructionally simplified production line can be increased as compared to the speeds up to date, resulting in increased output without notably increasing the power consumption. In addition, the inventive arrangement of the individual elements results in substantially more favorable conditions for the mounting, maintenance and adjustment since no drive chains or projecting guide and retaining mechanisms are necessary for the cooperation of the parts.

In accordance with the basic idea of the invention, the individual manufacturing devices are designed so as to contribute to the continuous operation of the entire machine in an advantageous manner and, as far as possible, directly. Therefore, preferred embodiments of the invention are represented by specific designs of the individual working mechanisms.

A first embodiment relates to the continuous supply and reception of the tags with the thread. In accordance with the invention, a thread-tag strand, formed outside in a stationary device, is fed, through a stationary feed channel, into a tag receiving pocket provided on the rearward raising arm and equipped with retaining means, for example, holding clips, which, at the introduction of the tag, spring apart, and a ram is provided, mounted outside the conveyance path and actuated in the working rhythm of the thread-tag fastening device, for pushing the tag into the pocket.

Thus, in contrast to the corresponding device used in the known machine, the feeding of the tag into the zone of the continuously circulating manufacturing units is based on a simple principle of insertion, and any receiving and transferring grippers traveling along and individually controlled may be omitted. This is a substantial constructional simplification and operational improvement because the thread-tag strand can be formed very rapidly.

For the same purpose, in accordance with a development of the invention, the movable part of the cutting device, provided for separating the tag from its strand, is mounted so as to push the tag, already fastened to the thread, through a lateral opening into the feed channel. The feed channel is provided with lateral, outwardly beveled, elastic retaining dogs which spring apart upon introduction of the tag with the thread fastened thereto and, after having subsequently sprung back, engage over the border of the lateral opening.

Due to the continuous circulation of the conveyer, carrying the manufacturing units, the thread-tag strand is pulled along also continuously while, at the same time, at each fastening operation, the thread and the tag are temporarily fixed in the stationary fastening device. In order to coordinate these two operations in favor of the operational continuity, in accordance with the invention there is provided, in the zone of the feed channel, a drive arm which is controlled in synchronism with the working cycle of the thread-tag fastening device and can be introduced, while entraining the thread, into an opening extending transversely through the feed channel to form a spare loop of the thread prior to the fastening of the thread to the tag, the drive arm being withdrawn again as soon as the thread is fixed by the fastening device.

The means for retaining the supplied bag strip in the manufacturing unit as well as for forming the bottom of the bag are improved, in accordance with the invention and relative to the design of the known machine, both as to the operation and construction, by providing two clamping arms which are mounted on the common supporting frame of the manufacturing unit, extend at an angle relative to each other, are movable parallel to the bag strip and against each other under the action of a spring and are actuated by means of a control plate which is secured to a controlled push rod and movable in the bisecting line of the angle formed by the clamping arms. Each of the clamping arms is provided with a guide slot for receiving controlled clamping holders which are adapted to clamp the bag strip in the zone of the guide slots so that, with the aid of a fold plate which is movable, along with the control plate, from below against the bag strip, a W-shaped bag bottom is formed.

In accordance with the invention, the clamping holders are carried by two swing arms which are mounted for movement relative to each other on a tappet arm comprising a slider portion extending at a right angle to the tappet axis and guided in a curved guide groove of a control or cam plate. At the knee point of the tappet, a journal bolt is provided which is seated in a guide slot provided in a bracket of the supporting frame of the unit and extending longitudinally of the tappet. The journal bolt is loaded by a compression spring, and the swing arms are provided with stop shoulders limiting their inward motion to which they are urged by the compression spring and by the guide groove, the inward and outward motions, or the up and down motion, of the clamping holders being made possible by the cooperation of the journal bolt with the guide slot.

For the formation of the bag top and the top closure, in accordance with the invention, there are used means which are again more simple than those of the prior art, and it is particularly advantageous that the folding of the top portion in the first closing operation can be executed by means of the raising elements so that separately mounted mechanisms are no longer needed, whereby the operational reliability is increased. To this end, in accordance with the invention, one of the raising arms carrying the receiving pocket for the tag is provided with a fold shoulder projecting in the longitudinal direction beyond the frame of the unit while the other raising elements comprise a forming member as well as two controlled folders with folder shoes which can be swung against each other in a swinging plane extending perpendicularly to the swinging plane of the raising arms, and the border portions of the bag can be folded, by means of the folder shoes, over the oblique shoulders of the forming member and over the fold shoulder of the receiving pocket and, subsequently, moved against each other to accomplish the V-shaped fold of the bag top, in which position the erected closed bag is clamped between the fold shoulder and the folder shoes.

Further, in accordance with the invention, the device for accomplishing the top closure and fastening the thread is mounted on a pivoting arm whose pivot is carried by the common supporting frame of the manufacturing unit and disposed perpendicularly to the bag strip path so that the pivoting arm is pivotable out of and into this path. The pivot is mounted for axial displacement in a rotatable hub but secured against rotation relative thereto, and is adapted to be controlled in accordance with the cycle of the machine so that the pivoting arm, carrying the fastening device, passes over the upright positioned bag while simultaneously folding the top portion of the bag, then projecting upwardly, and is subsequently lowered so that the folded portion is applied against the top of the bag and fastened thereto along with the thread. Here again, in accordance with the objective of the invention, the substantial advantage is obtained that the tools proper are located on the common supporting frame of the manufacturing unit and controlled from the outside with the aid of simple means.

Finally, the device for removing the finished bag from the path of conveyance is also improved relative to the prior art, due to the provision, in accordance with the invention, that the raising elements, with the bag halves, can be pivoted into their initial position which is tangential to the conveyance path and that, subsequently, the bag, which is folded over the top of the one of the raising elements, can be picked up by means of a controlled tongs mounted outside the conveyance path, and removed from this path by a further displacement of the tongs.

The present invention is based on the idea that the individual manufacturing mechanisms circulate continuously along the endless conveyance path, as on an endless conveyor, and that, with each of the manufacturing units, one set of these manufacturing mechanisms is constructionally and operationally associated and mounted on the respective common supporting frame. As follows from the present disclosure, the mechanisms provided may be broken down into mechanisms disposed in front of the working plane of the means of conveyance and designed without a motion component directed transversely to the bag circulation path (raising elements and auxiliary equipment) and mechanisms which are mounted behind the path of conveyance and have motion components directed transversely to the path of conveyance (clamping holders, cutting device, fastening device with the top folding mechanism and auxiliary devices).

Since, in terms of construction, such an association can be realized in various manners, a further design is provided within the scope of the main idea of the invention. In accordance therewith, the individual motion components of certain manufacturing mechanisms may be united in a common infeed motion, the result being reduced constructional expenses and saving of space.

This is obtained by mounting those manufacturing mechanisms, having coordinatable motion components directed transversely to the bag circulating path, on a common supporting part which is movably guided in the manufacturing unit, transversely to the bag circulating path, and the transverse displacement of which is controllable in accordance with the machine cycle.

An object of the invention is to provide an improved machine for making bag-like two-compartment packages from a pliant material, particularly tea bags, each having a tag secured thereto by a thread and which tea bags are formed and closed exclusively by folding operations.

Another object is to provide such a machine having increased manufacturing capacity with reduced need of attendance and susceptibility to disturbances.

A further object of the invention is to provide such a machine in which all the device for folding, closing and separating a bag from the strip form a manufacturing unit in which the devices are mounted on a respective common supporting frame for conjoint movement along a conveyance path, a series of manufacturing units being movable along the endless conveying path.

For an understanding of the principles of the invention, reference is made to the following description of typical embodiments thereof as illustrated in the accompanying drawings.

BRIEF DESCRIPTION OF THE DRAWINGS

In the Drawings:

FIG. 2*a* is a plan view, partly broken away, corresponding to FIG. 2, as showing details of the cutting mechanism;

FIG. 4*a* is a perspective view illustrating the detail of the means shown in FIG. 4;

FIG. 4*b* is a sectional view of a folding shoulder taken along the thread-tag strand;

FIG. 10 is a side elevation view of the two raising elements together with the drive and folders;

FIG. 11 is an elevation view, partly in section, illustrating the raising elements, with the bag compartments, in erected position;

FIG. 12 is an elevation view, partly in section, of the cutting device with the bag strip;

FIG. 13 is an elevation view of the bag prior to the final forming of the top closure;

FIG. 13*a* is an elevation view looking from the right of FIG. 13;

FIG. 16 is a view illustrating, somewhat diagrammatically, the means for removing the finished bag;

FIG. 16*a* is a view illustrating a typical tongs for removing the finished bag;

DESCRIPTION OF THE PREFERRED EMBODIMENTS

Figure 1:
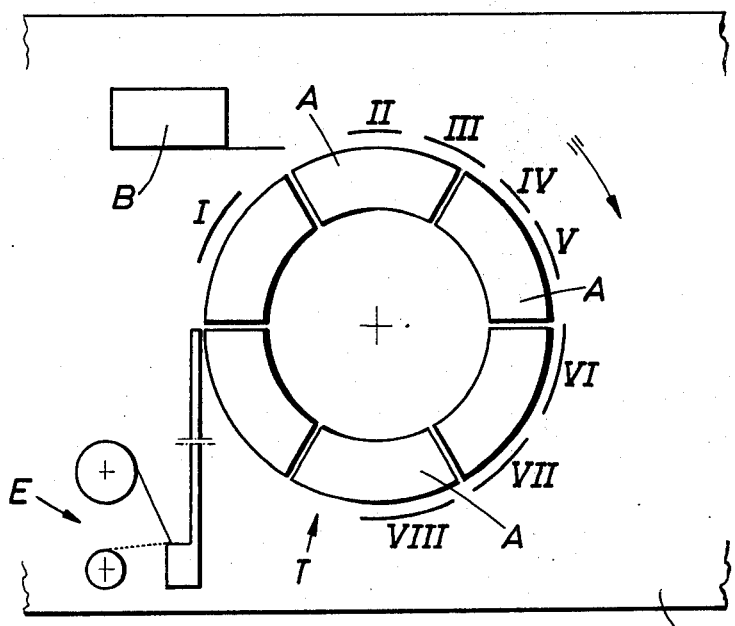
FIG. 1 is a diagrammatic illustration of the operational zones of the manufacturing units and in which a conveyor, with the manufacturing units secured thereto is assumed as circulating clockwise along a horizontal conveyance path.
Figure 2:
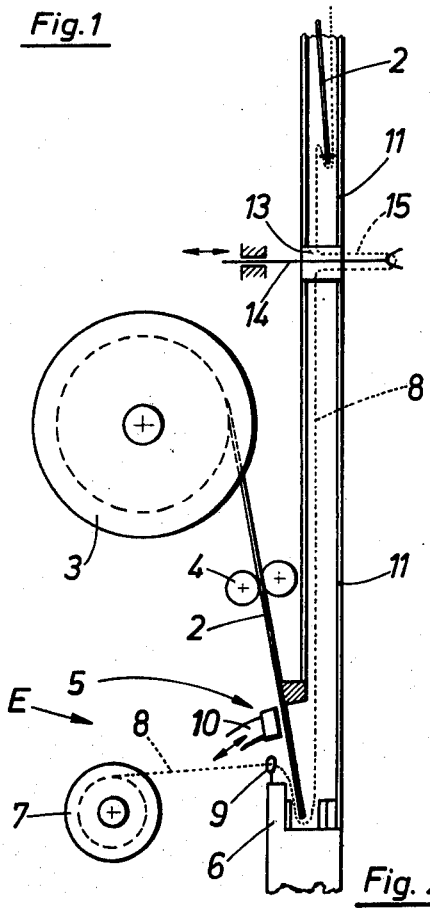
FIG. 2 is a plan view, partly in section, of the device for forming and guiding the thread-tag strand.
Figure 3:
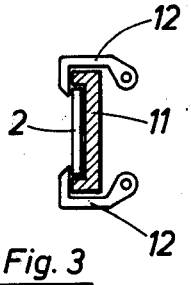
FIG. 3 is a transverse cross-sectional view of the feed channel illustrating the tag retaining dogs.

Referring first to FIGS. 1, 2 and 3, a means of conveyance T, such as an endless conveyor, is supported on a machine frame 1 and carries the manufacturing units A each having a respective common supporting frame 16 secured to conveyance T for unitary movement therewith. In advance of the conveyance means T, there is provided a device B for forming the bag strip and in which the bag strip is filled with dosed portions of the substance to be packaged. The device B also may be designed as a separate unit.

The conveyance means T passes continuously through the following operational zones, as shown in FIG. 1:

I. Transfer of the thread-tag strand to the means of conveyance T;

II. Transfer and retention of the bag strip as well as separating of the forwarding part thereof comprising a two-compartment bag strip section, and cutting of the tag thread;

III. folding of the bag bottom;

IV. erection of the two bag-compartment portions and preparation of the top closure;

V. finishing of the top closure and fastening it with a clip;

VI. removal of the folders and clamping holders;

VII. returning the bag into the flat position; and

VIII. removal of the bag.

At the entry end of the mentioned zones, the device E for preparing and feeding the thread-tag strand is installed. The tags 2 are supplied as a strand from a supply reel 3 by means of a delivery device 4 in the rhythm of the machine and fed in the cutting device 5 as well as in a fastening device 6.

Further, the tag thread 8 is supplied, in the rhythm of the machine, from a thread reel 7 and fed through a guide eye 9, provided on fastening device 6 to a location in front of the then leading edge of the tag 2 where it is passed around this edge so as to be fastened to both sides of the tag. Thereupon, the foremost tag 2 is separated from the strand by means of cutting device 5 and the movable part 10 of the tool pushes the tag into a feed channel 11. In this channel, the thread-tag strand is advanced to the zone I where it is received, in a manner described hereinafter, by a manufacturing unit A forming the two-compartment bag.

As shown in FIG. 2a, the tool for cutting the labels comprises a fixed part 10*a* cooperable with with a movable part 10. Movable part 10 is carried on a lever 10-1 mounted on a pivot 10-2 and pivotal about this pivot by a cam 10-5 and a cam follower 10-3 connected to lover 10-1 at the articulation point 10-4. Movable part 10, in cooperation with fixed part 10*a*, cuts label strip 2 at the location 5 and moves the cut label, which is retained at this time in the fastening device 6 of FIG. 2, to the right and to the resilient part of feed channel 11 where it is retained by the spring-biased dogs 12 of FIG. 3.

As shown in FIG. 3, feed channel 11 is provided laterally with elastic or resilient retaining dogs 12, biased inwardly by springs 12*a*, which are beveled outwardly and which, at the introduction of the tag into the channel, spring apart and, after having subsequently sprung back, engage over the border of the lateral channel opening to hold the tag down in flat position and thereby to secure its guidance. Channel 11 is further provided with a transversely extending through-opening 13 into which a controlled drive arm 14 can be introduced in accordance with the working rhythm of the machine. Thereby, a spare loop 15 of the thread is formed prior to the fastening of the thread to the tag. As soon as the thread is fixed by fastening device 6, the drive arm is moved back. While conveyance means T and the manufacturing units A forming the bags advance continuously, the necessary length of the thread can be pulled from spare loop 15 during the time the following tag is retained in fastening device 6 for the fixing operation.

In the following operational zones II to IV, the mechanisms for the reception of the tag, retaining of the supplied bag strip, cutting of the thread, forming of the bottom fold, cutting of the bag strip, erecting of the bag halves and preparation of the top closure, are actuated. This controlled actuation is effected, preferably, by stationary and conventional means, particularly cams and other drive elements.

Figures 4, 5, 6:
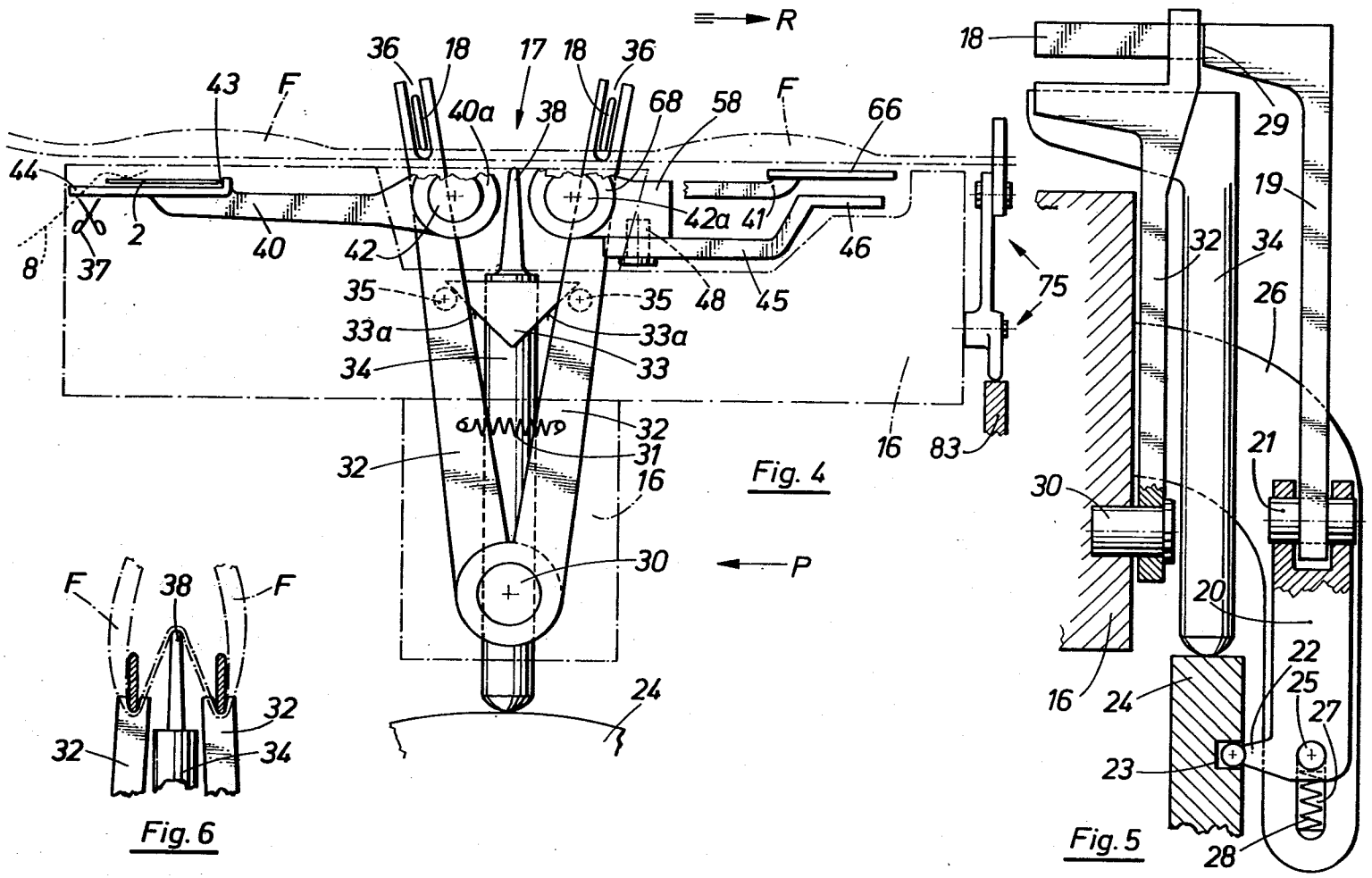
FIG. 4 is a partial elevation view of a manufacturing unit illustrating the means for erecting the bags and forming the bag bottom.
FIG. 5 is a part elevation and part sectional view corresponding to FIG. 4 and looking in the direction of the arrow P.
FIG. 6 is an elevation view, partly in section, of a detail of FIG. 4.

The means provided, in accordance with the invention, for the mentioned operations are shown in FIGS. 4 and 5 where, for clarity, unimportant and known details irrelevant for the invention have been omitted and are not described either.

The mentioned means are constituents of each manufacturing unit A and designed so that the bag strip 17 can be freely supported by the respective common supporting frame 16 of each unit A. For retaining the bag strip, two clamping holders 18 are provided, each carried by a swing arm 19 and both are mounted for movement against each other on bolts 21 provided on a tappet arm 20. Tappet arm 20 comprises a slider portion 22 extending at a right angle thereto and guided in a cam groove 23 of a cam plate 24 which is located outside the path of conveyance. At the knee point of tappet arm 20, a journal bolt 25 is provided and seated, while loaded by a compression spring 28, in a guide slot 27 which is provided in a bracket 26 of common supporting frame 16 of the manufacturing unit and extends longitudinally of tappet arm 20. To limit their inward motion transversely to the bag strip to which they tend because of the action of spring 28 and guide groove 23, clamping holders 18 are provided with stop shoulders 29.

In addition, common supporting frame 16 carries two clamping arms 32, forming an angle with each other, which are mounted on a bolt 30 secured to frame 16 and movable relative to each other against the action of an intermediate compression spring 31. A triangular control plate 33 is located between clamping holders 18 and secured to a ram 34 which is movably guided in frame 16 transversely to bag strip 17. Control plate 33 comprises two lateral edges **33*a*, extending obliquely to the central axis, by which it bears against pins 35 provided on each of the clamping arms 32. At their free ends, clamping arms 32 are provided with respective guide slots 36 and arms 32, or guide slots 36, are disposed so that clamping holders 18 can engage into slots 36 and are movable radially to the path of conveyance means T, with stop shoulders 29 engaging arms 32 to limit the radially inward movement. Ram 34 has a lower end which cooperates with a cam plate 24 which is located outside the conveyance path and, if necessary, actuates the ram in accordance with the rhythm of the machine. At its other end, ram 34 carries a fold plate 38 which, in the operational phase shown in FIG. 4, is positioned below bag strip 17** and in the middle between the filling compartments F.

Further mechanisms mounted on each common supporting frame 16 serve to erect the two bag halves, and comprise raising elements 40, 41, 58 which are mounted on respective pivots **42, 42*a* secured to the frame 16, and are pivotable upwardly as viewed in FIG. 4. In FIG. 4, the arms 40 and 41 are shown swung downwardly. Arm 40 is adapted to receive tag 2 and, to this end, is provided with a pocket or receiving member 43 at its outer end. In addition, this arm is provided with a fold shoulder 44 shown more fully in FIG. 9. Arm 40 is shown swung upwardly. The raising elements for the right-hand side of the bag section comprise arm 41 and a swing arm 58, both pivoted on pivot 42*a*. Arm 41 is also shown as swung upwardly. Arm 41 is provided with two mutually opposed folders comprising levers 45 each of which carries a folder shoe 46, and both levers are mounted on bolts 48 on swing arm 58 for pivoting toward each other in cooperation with a compression spring 47, the pivoting plane extending transversely to the advance direction of bag strip 17. These parts are shown more clearly in FIG. 7**.

Figure 7:
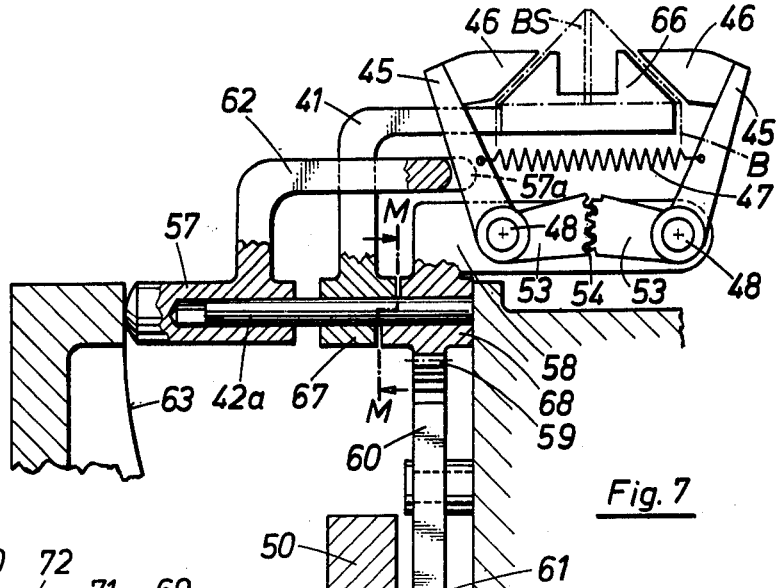
FIG. 7 is an elevation view, partly in section, illustrating further individual mechanisms of each manufacturing unit, looking in the direction of circulation.
Figure 9:
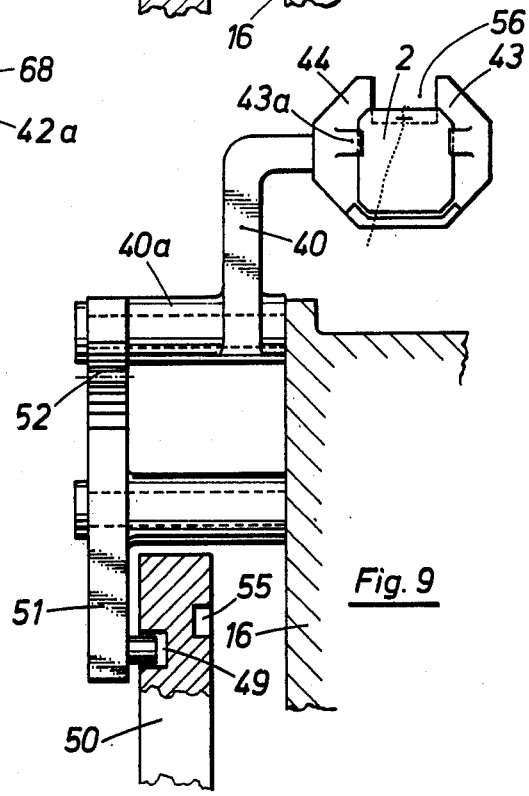
FIG. 9 is an elevation view, partly in section, illustrating the drive of a raising arm having the tag pocket, and looking in the circulating direction.

As shown in FIGS. 7 and 9, the raising motions of raising elements 40, 41, 58 are derived from cam tracks 49 or 55 of a control plate 50 and positively transmitted, through respective pins 61, respective levers 51, 60, and respective gearings 52, 59 to the respective hubs **40*a*, of arm 40, and 68, of lever 58**.

To impart a controlled opposite motion to folders 45, 46, their levers 53 are coupled, for example, through gearing 54. Through a push member 57, comprising an arm 62 and a fork **57*a* engaged over one of the arms 45, which is axially displaceably mounted on pivot 42*a*, folders 45 receive their impulses in the rhythm of the machine for pivoting transversely to the bag advance, the impulses being imparted to push member 57 by a control cam 63. Under the action of compression spring 47, push member 57 is constantly biased against cam 63. Due to fork 57*a*, arm 62 follows the motions of arm 45**.

Figure 8:
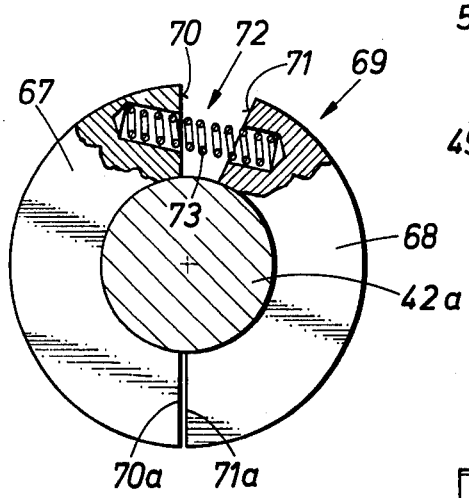
FIG. 8 is an enlarged partial sectional view taken along the line M—M of FIG. 7.

The angular lever arm 41 carried by pivot 42a is provided with a shape piece 66. Hub 67 of this lever arm 41 is carried along with hub 68 of swing arm 58, due to a coupling 69 shown in FIG. 8. For this purpose, hubs 67 and 68 are segmentlike recessed and assembled so that, with their contact surfaces **70*a* and 71*a* engaged, a sector 72 is left free between the driving surfaces 70 and 71. A compression spring 73 mounted in this sector between the surfaces constantly biases surfaces 70*a* and 71*a* toward contact. As soon as swing arm 58 or its hub 68 is moved counterclockwise, due to spring 73, hub 67 or lever arm 41 follow this motion until lever arm 41 abuts against a resistance (fold shoulder 44) and is stopped upon compression of spring 73 so that arms 45 carrying the folder shoes 46 can move beyond shape piece 66. If swing arm 58 is moved clockwise, first, spring 73, if compressed, is relieved and lever 41 (or its hub 67) can remain in its position or even move farther in the opposite direction until the two surfaces 70a, 71a contact each other again and also the two hubs 67, 68** are positively coupled again.

The described individual mechanisms are arranged in the manufacturing unit A so that their pivotal or motion planes are disposed one after the other. In FIG. 4, for clarity, the drive means for moving the clamping holders 18 are not shown and, in FIGS. 5 and 7, the raising elements 40, 44, 56 are not shown for the same reasons.

In FIG. 12, the cutting device 75 indicated in FIG. 4 is shown in more detail. Cutting device 75 is mounted on the part of manufacturing unit facing ahead so that the fed-in bag strip can be separated from the advanced section before zone III. Thus, the bag compartments F of the advanced section can be erected in time, whereby tea losses are prevented.

More specifically, device 75 comprises a swing lever 76 which is mounted on common supporting frame 16 of the manufacturing unit for pivoting about a bolt 77 transversely to bag strip 17. At the upper end of lever 76, two scissor blades 79 are mounted on a bolt 78 for movement against each other and against a compression spring 80. Both blades 79 are provided with a nose 81 extending at an angle.

At its other end, lever 76 is formed with a tracing portion or cam follower 82 which is actuated, in the direction of the arrow and against the action of a compression spring (not shown), by a cam 83 located outside the conveyance path, so that blades 79 engage over the bag strip 17. Due to a further motion of lever 82, 76, noses 81 abut against two stops 84 adjustably mounted on frame 16, so that scissors blades 79 close and bag strip 17 is cut in the zone between two pairs of filling compartment F (FIG. 4).

In the following, the mode of operation of the individual mechanisms shown in FIGS. 4 to 16 is described in the order of the diagrammatical representation in FIG. 1. The manufacturing units A on the conveyance means move in the direction of arrow R (FIG. 4). Manufacturing units A are designed so that bag strip 17 comprising pairs of filling compartments F can extend tangentially to the path of conveyance and the space above the bag strip is freely accessible.

Referring to FIGS. 4*a* and 4*b*, in zone I label 2, after being pulled by thread 8 directly in front of retaining springs or clips 43a, which are spaced apart laterally, is to be pushed under these springs which are at the end of the pocket 43 of folding shoulder 44. This position is also shown in FIG. 4*b*, which is a sectional view of folding shoulder 44 taken substantially along the thread 8, and in which the label is positioned just in front of retaining springs 43*a* after having been brought into this position by an appropriate selection of the length of thread 8. A push rod 44-1 now pushes label 2 beneath retaining springs 43*a*. For this purpose, push rod 44-1 is mounted on a suitably designed mechanism, for example a four-bar linkage 44-3, which is so dimensioned that, during its accompanying motion, it runs at a speed somewhat above that of working stations A, thereby pushing label 2 below springs or clips 43*a*. At the same time, its undersurface 44-2 ensures that, during this phase, label 2 lies in label pocket 43 neatly and flatly.

For fixing bag strip 17, in zone II, clamping holders 18 are moved, following groove 23, horizontally into the position shown in FIG. 5, above the bag strip. Thereupon, they are lowered until they fully engage in guide slots 36 of clamping arms 32 and are applied against the bag strip while clamping the same to frame 16 of the manufacturing unit A in the portion between filling compartments F (FIGS. 5 and 6).

The movements of clamping holders 18 are effected through parts 22 to 28. That is, as soon as cam groove 23 urges the slider portion 22 from the illustrated position downwardly, swing arm 19 attempts to pivot to the left (FIG. 5). This is prevented by stop shoulder 29 and cam 19 is pulled downwardly, against the action of spring 28, whereupon bag strip 17 is clamped.

Right before the respective manufacturing unit A enters the operational zone III, cutting device 75, shown in FIG. 12, cuts the bag strip at the transition point between the leading portion and the rear portion of the strip so that, in each case, there are formed bag sections, each comprising two filling compartments F. The operation of the cutting device is controlled by cam plate 83. At the same time, the tag thread is cut, which may be effected by means of cutting device 75 or by another, separate mechanism.

To form the bag bottom in zone III, fold ram 34 is moved by cam plate 24 upwardly by half the distance between clamping holders 18, whereby control plate 33 is moved along thus permitting the two clamping arms 32 to move, under the action of tension spring 31, toward each other to allow forming of a bottom fold as shown in FIG. 6.

All of the described operational movements are actuated off the cam plate 24 which may be mounted about the center of conveyance path T.

Thereupon, in zone IV, the two bag halves are erected, to which end the devices shown in FIGS. 4 and 7 to 11 are used. Actuated by the already described means shown in FIG. 10, the raising elements 40, 41 58, hitherto positioned below the bag strip, are pivoted into the position shown in FIG. 11. The arrangement is such that, relative to bottom folding plate 38, the respective separated section of bag strip 17 is placed eccentrically so that upon erection, the raised bag portions are of unequal length and, as shown in FIG. 11, the right-hand portion 86 projects above the other portion 85. Since portion 85 reaches approximately up to the upper edge of fold shoulder 44 carried by raising arm 40, the other portion 86 projects upwardly beyond this level.

Along with arm 58, arms 45 of the folders are also raised so that, at present, their folder shoes 46 are positioned immediately in front of bag portion 86, the bag being clamped between parts 44 and 66.

Since, at the end of the erection, shaped piece 66 is prevented from moving farther (perpendicularly to the drawing plane, FIG. 7) by fold shoulder 44 carried on arm 40, arm 41 is stopped while arm 58 can continue to move. Thereby, folder shoes 46 brush the projecting corners of the bag over shoulder 44 so as to fold the corners along lines forming an inverted V. Subsequently, cam 63 becomes effective and push member 57 comprising arm 62 is displaced, on pivot 42a, to the right (FIG. 7) so that arms 45 with the folder shoes 46 are moved toward each other thereby completing the V-folding of the bag top through 180° (indicated in dash-dotted lines). The preliminary shaping of the top closure is thereby terminated. The obtained shape of the bag is shown in a front and lateral elevational view in FIGS. 13 and 13*a*, respectively, the uppermost portion of the bag top to be folded in addition along line V—V being indicated a BS.

Figure 14:
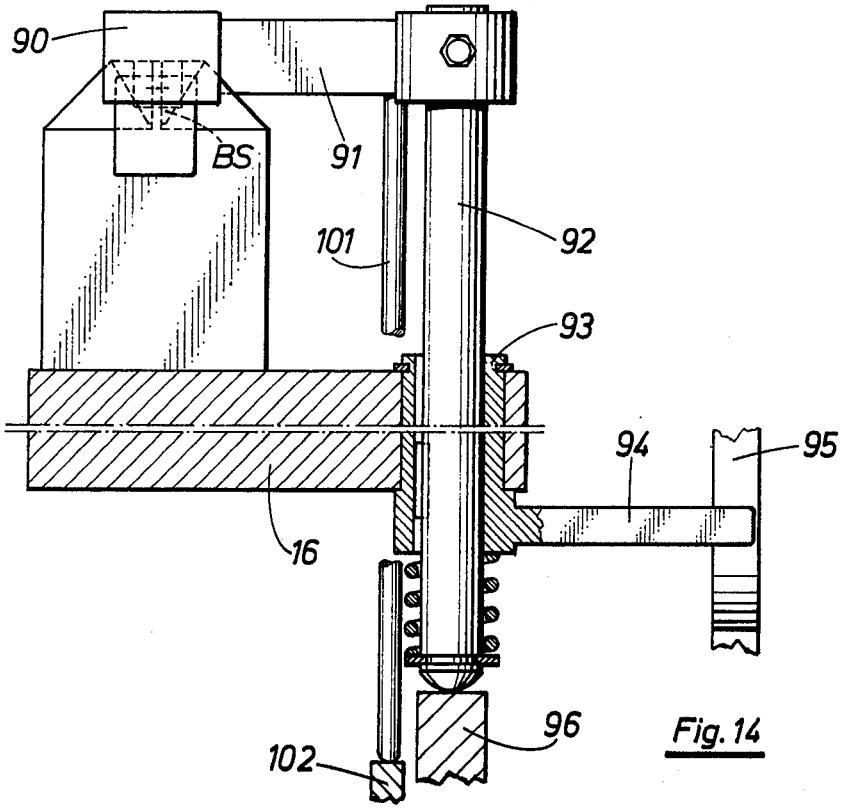
FIG. 14 is an elevation view, partly in section, illustrating the device for fastening the thread to the bag, looking in the direction of circulation.
Figure 15:
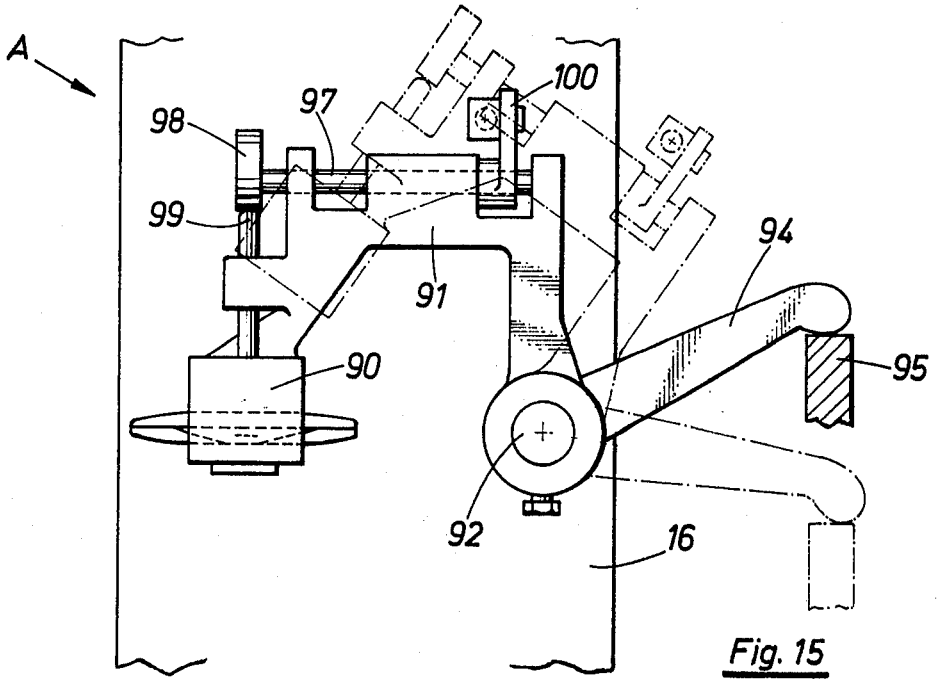
FIG. 15 is a top plan view, partly in section, corresponding to FIG. 14.

In principle, the final shaping of the top closure including the fastening of tag 2 in the zone V could be effected in the same manner as usual in the prior art, in which case, the top corner is folded simultaneously with the fastening of the thread. Within the scope of the present invention, however, it is more advantageous to provide the fastening and folding device also on the respective common supporting frame 16 of each manufacturing unit A, as shown in FIGS. 14 and 15. In such an arrangement, the fastening device 90 is mounted on a slewing arm 91, which is secured to a pivot 92. Pivot 92 is received in a hub 93 so as to be displaceable axially but secured against rotation therein. Hub 93 is rotatably mounted in common supporting frame 16 of the manufacturing unit A and receives its rotary impulses through a radial control lever 94 which cooperates with a cam plate 95. The axial movements of pivot 92 are controlled by a cam disc 96 in accordance with the cycle of the machine.

The drive shaft 97 for actuating fastening device 90 is mounted in slewing arm 91, and the necessary movements are transmitted by a cam disc 98 and a pushing rod 99 actuating the expelling and fastening of the staple. Shaft 97 may be driven, for example, by a lever 100 which is secured to shaft 97 and articulated to an auxiliary pushing rod 101 receiving its motion from a cam disc 102.

The bottom edge of fastening device 90 is positioned so low that, in moving against the top corner BS of the bag (which has already been shaped in accordance with the above description), this corner is folded through 90°. By a subsequent lowering of pivot 92 and thereby fastening device 90, the folding of top corner BS is completed through 180° and the shape indicated in FIG. 14 is obtained. Thereupon, tag thread 8 is fastened to the top of the bag and, at the same time, the closure is stapled.

The foled shoulder 44 or its receiving pocket 43, respectively, comprises a recess 56 (FIG. 9) providing for the necessary free space above the inserted tag 2 for the fastening of the thread to the bag or stapling of the bag closure. This recess may also be instrumental as a space into which the blades of a thread scissors (not shown) extend which, at the same time, may form the backing for the tag.

After completion of the bag, fold shoulder 44 is enclosed between the neck H of the bag and the folds of the closure (FIG. 16). In addition, the finished two-compartment bag DB is clamped between fold shoulder 44 and shape piece 66. In this situation, first, in operational zone VI, clamping holders 18 are moved outwardly into their inoperative position so that, in this direction, bag DB is no longer clamped. Thereupon, in zone VII, raising arm 40 with the bag top folded over fold shoulder 44 is swung back, tangentially to the run of conveyance means T, into the position shown in FIG. 16. Further, the parts mounted on pivot 42a are swung back into their initial tangential position while, previously, in zone VI, folder shoes 46 have been brought back into their position shown in FIG. 7.

The removal of bag DB in operational zone VIII is effected by means of a tongs 105 which, in its turn, performs a controlled motion along a path 106, outside the main conveyance path. Along this path 106, the following operations are performed:

In zone 107, tongs 105 catches up and overtakes bag DB;

In zone 108, tongs 105 travels in synchronism with the bag and grips it;

In zone 109, tongs 105 travels slower than the bag and, thereby, pulls the bag off fold shoulder 44;

In zone 110, tongs 105 has moved out of the circulation path and delivers the bag to further treatment, for example, storing, cartoning, further packaging, etc.

The tongs 105 is similar to that shown in U.S. Pat. No. 3,774,369, FIG. 8. However, because of the continuous operation, tongs 105 does not perform a reciprocating movement but, in accordance with the invention, circulates along the path 106 which is adapted to the problem to be solved. While the tongs may take any suitable form, a possible design is shown in FIG. 16*a.*

The first leg 105-1 of tongs 105 is mounted on a pivot 105-2 of a second swing lever 105-3, and is actuated by a crank 105-4 acting on the second arm 105-5 of leg 105-1. Thereby, there can be produced a travel of the end of leg 105-1 remote from crank 105-4 which can easily be adapted to follow the motion of the bag, for example along a kidney-shaped path.

The second leg 105-6 of tongs 105 is pivoted to the first leg 105-1 at a pivot 105-7, and is actuable, through its second arm 105-8 and a control leg 105-9, shown in a dot-dash line, for an opening and closing motion of the tongs 105. The control motion of the second leg 105-6 is effected through a cam 105-12 through a two-arm lever 105-10 pivoted intermediate its ends and connected to the length 105-9. As soon as lever 105-10 arrives in the trough of cam 105-9, the tongs 105 is closed by the action of spring 105-11 engaged between the first leg 105-1 and the second arm 105-8 of second leg 105-6. Spring 105-11 can compensate the unavoidable varying thicknesses of the bag head.

Figure 17:
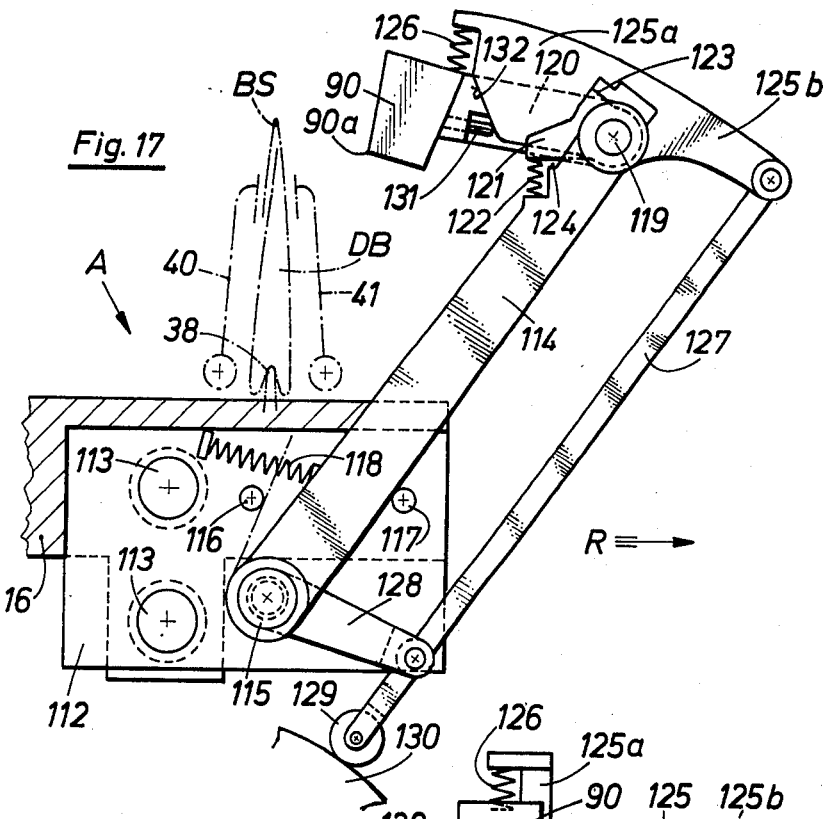
FIG. 17 is an elevation view, partly in section, of an arrangement for coordinating the transverse motion of the manufacturing mechanisms, looking in the direction of circulation.
Figure 18:
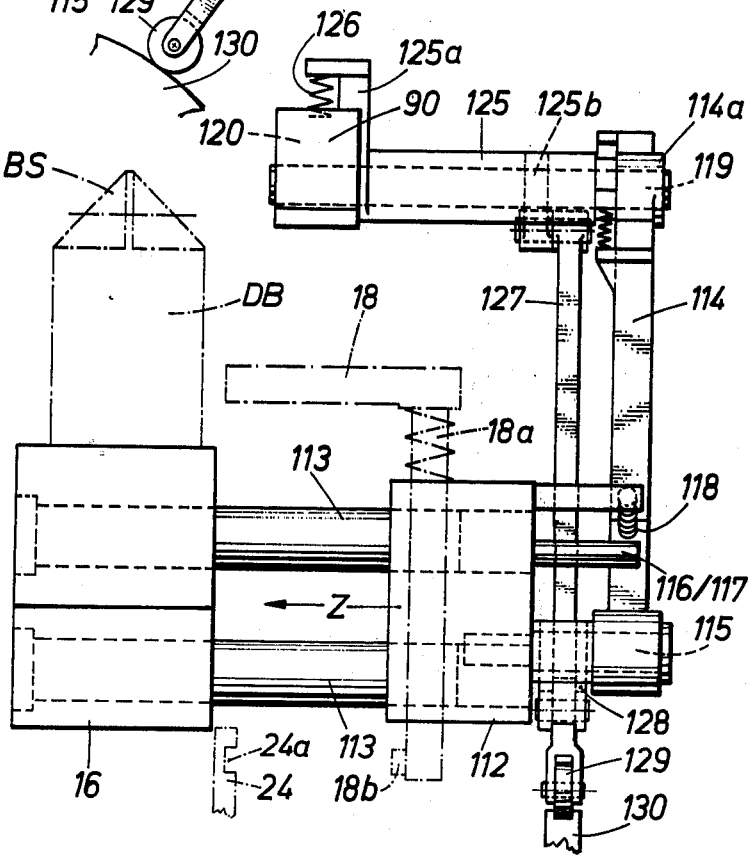
FIG. 18 is a side elevation view corresponding to FIG. 17.

The arrangement shown, by way of example in FIGS. 17 and 18, makes it possible to unite the motion components directed transversely to the bag advancing direction (arrow R) to an infeed motion (arrow Z) which is performed by clamping holders 18 (FIGS. 4 and 5), fastening device 90 (FIGS. 14 and 15) and cutting device 75 (FIG. 12).

In the following, to clarify the description, only working mechanisms 18 and 90 are discussed. These mechanisms are mounted on a common support 112 which is displaceable transversely to the advance direction of unit A on guide bars 113. Bars 113 are supported on common supporting frame 16 of manufacturing unit A. Fastening device 90 has to execute two operations, namely, the folding of bag top BS through 180° and the stapling of this top along with the tag thread while, for its transverse or infeed motion Z, the simple transverse mobility of the support 112 already provided for the clamping holders may be used.

To ensure the mentioned operations of the fastening device, a lever arm 114, pivotable about a bolt 115 between stops 116 and 117, is mounted on support 112. In the rest position shown, lever arm 114 is biased by a compression spring 118 against stop 117.

At its outer end, lever arm 114 carries a hub 114a and a rotatable shaft 119 received therein and which extends parallel to guide bars 113 in a direction perpendicular to the circulation path of the bag. A staple-head lever 120 carrying staple head 90 is secured to shaft 119. Further, shaft 119 carries a small lever 121 which, along with staple-head lever 120, is movable between stops 123 and 124 of lever arm 114 under the action of a compression spring 122.

In addition, a long hub 125 is mounted for free rotation on shaft 119 and carries a double lever whose one arm 125*a* applies, through a compression spring 126, against staplehead lever 120 while its other arm 125*b* is hinged to a push rod 127. This push rod is guided, by means of a lever 128, about the axis of bolt 115 and applies, through a roller 129, against a cam disc 130.

Springs 126, 122 and 118 are dimensioned so that spring 126 is stronger than spring 122 and spring 22 is stronger than spring 118.

FIG. 17 also shows raising arms 40 and 41 (FIG. 4) as well as fold plate 38. Further, FIG. 18 shows the vertical guide means 18*a* of the clamping holders in support 112 as well as cam plate 24 with a guide groove 24a into which a pin 18*b* is engaged.

The working mechanisms are shown in their outer rest position in which support 112 with its individual parts is transversely most remote from common supporting frame 16 and in which lever arm 114 is swung out up to stop 117.

The outer rest position corresponds to the starting period of the working operations, thus to zone I of the diagrammatical showing of FIG. 1. However, for a better understanding of the subsequent operations, bag DB is shown already in its finished shape which would be obtained only in zone IV where fastening device 90 and clamping holders would occupy their inside positions in which support 112 is in its left extreme position and clamping holders 18, as well as raising arms 40, 41, retain the bag in the position shown.

To come to this working position, during the transition period from zone I to zone II, support 112 is moved, by means of a control mechanism (not shown), to the left, into its mentioned inside ready-position. Simultaneously, pin 18b is introduced into groove 24*a* of cam plate 24 so that, subsequently, clamping holders 18 are brought into their clamping position shown in FIG. 4. Thereupon, after bag DB has been formed into its shown shape by means of the raising and folding elements in the described manner, the final folding of the top closure and stapling of the tag thread is carried out in zone V.

For this purpose, through cam plate 130, push rod 127 is moved upwardly. Thereby, first, lever arm 114 is swung, against the action of spring 118, up to stop 116, during which motion lever 120, carrying staple head 90, passes over the bag and, by means of its edge 90*a*, folds the bag top BS to the left through 90°. At the left extreme position of lever arm 114, staple head 90 is positioned above the partly folded bag top BS. Due to further motion of push rod 127, lever 125*a*, through spring 126, pushes staple-head lever 120 and, thereby, small lever 121, against spring 122 down to stop 124, during which motion staple head 90 folds the partly folded bag top through a further 90° downwardly and applies it against the bag. Subsequently, further motion of push rod 127 overcomes the pressure of spring 126 so that lever arm 125a is also swung downwardly about shaft 119. During this motion, a ram 131, provided in staple-head lever 120, is displaced, by means of an oblique surface 132 of lever arm 125a, to the left. In the staple head, this motion effects the stapling of the tag thread and of the folded bag top to the bag.

Thereupon, push rod 127 is moved, under spring pressure, downwardly again so that the described operations are performed in the inverted order until the shown initial position is reached and the following working operations in zone VI can be carried out.

While specific embodiments of the invention have been shown and described in detail to illustrate the application of the principles of the invention, it will be understood that the invention may be embodied otherwise without departing from such principles.

I claim:

1. In a machine for making bag-like compartment packages of a pliant material, particularly tea bags having a tag secured thereto by a thread, which are formed solely by folding operations and closed by staples, from bag strips, filled with dosed portions of the substance to be packaged, fed continuously into the machine, and of the type including conveyance means circulating along a closed conveyance path and having mounted thereon manufacturing units which are controlled by means located outside the conveyance path, with each unit including folding members for forming the bag bottom, two raising arms for erecting the bag halves and a member on one raising arm for receiving a tag, and also including a device for cutting the bag strip: the improvement comprising, in combination, said conveyance means being continuously movable without interruption along said conveyance path; a respective common supporting frame for each unit mounted on said conveyance means for movement therewith; means mounting on each common supporting frame, for conjoint movement therewith along the conveyance path, all the devices for folding, closing and separating a bag from the strip, including respective said raising arms, one of which has a pocket for receiving a tag, a respective fold plate movable transversely to the bag strip and associated, for forming the bag bottom, with respective clamping holders movable oppositely thereto, a respective device for cutting a tag thread, respective folders for forming the V-shaped top closure of the bag, a respective device for further folding and finishing the top closure and a respective device for fastening the thread to the bag top; and means mounted stationarily outside the conveyance path for movement of said common supporting frames successively thereby, and controlling the operation of all of the devices mounted on each common supporting frame.

2. In a machine for making bag-like two-compartment packages, the improvement claimed in claim 1, comprising a stationary device outside the conveyance path operable to form a thread-tag strand; a fixed feed channel extending from said stationary device toward said conveyance means for feeding the thread-tag strand from said stationary device into said pocket; said pocket being on the rearward raising arm considered in the direction of movement of said conveyance means; said stationary device including a thread fastening device operable to fasten a thread to a tag; tag retaining means on said pocket operable to spring apart responsive to introduction of a tag into said pocket and then to retain the tag in said pocket; and a push rod positioned outside the conveyance path and controlled by said thread fastening device in accordance with the working rhythm of said machine to push tags into successive pockets moving past said stationary device.

3. In a machine for making bag-like two-compartment packages, the improvement claimed in claim 2, in which said retaining means comprises fixing clips.

4. In a machine for making bag-like two-compartment packages, the improvement claimed in claim 2, in which said thread-tag strand forming device includes a cutting device operable to separate tags from a tag strand; said cutting device including a movable part operable to introduce a tag, which has been fastened to the thread, through a lateral opening in said feed channel into said feed channel.

5. In a machine for making bag-like two-compartment packages, the improvement claimed in claim 4, including resilient spring-biased dogs mounted on opposite sides of said feed channel adjacent said lateral opening thereinto, said feed dogs being beveled outwardly and, as a tag with the thread is introduced through said lateral opening, springing apart and, after subsequently swinging back, engaging over the border of said lateral opening.

6. In a machine for making bag-like two-compartment packages, the improvement claimed in claim 2, in which said feed channel is formed with an opening extending therethrough; a drive-in arm reciprocable through said opening in accordance with the rhythm of said thread-tag fastening device; said drive-in arm being movable through said opening while entraining the thread extending along said channel prior to fastening of the thread to a tag to permit the formation of a slack loop of the thread, said drive-in arm being retracted again as soon as the thread is fixed to a tag by means of said fastening device.

7. In a machine for making bag-like two-compartment packages, the improvement claimed in claim 1, in which, on each respective common supporting frame, two clamping arms are pivotally mounted to extend at an angle to each other; spring means interconnecting said arms and operable to bias said arms toward each other in a direction parallel to the bag strip; a control plate operatively engaged with said clamping arms; a controlled ram movable along the bisector of the angle formed by said clamping arms and operable to move said control plate in a direction to spread said clamping arms apart against the bias of said spring means, said controlled ram being reversely movable to move said control plate to release said clamping arms for movement toward each other under the bias of said spring means; each of said arms having a guide slot at its free end; controlled clamping holders mounted on each common supporting frame and engageable into said guide slot to clamp the bag strip in the zone of said guide slots; and a folding plate cooperating with and movable along with said control plate from below against the bag strip to form, in cooperation with said controlled clamping holders a W-shaped bag bottom.

8. In a machine for making bag-like two-compartment packages, the improvement claimed in claim 7, including a respective tappet arm mounted on each common supporting frame; two swing arms mounted for movement relative to each other on said tappet arm and each carrying a clamping holder; said tappet arm having a slider portion extending perpendicularly to its longitudinal axis; a cam plate mounted outside the conveyance path and formed with a cam groove engaged with said slider portions to guide said slider portions; said tappet arm having a pivot at the junction of said slider portion therewith; each common supporting frame carrying a bracket formed with an elongated slot receiving the associated pivot, the elongated slot extending longitudinally of said tappet arm; a compression spring in said slot biasing said pivot upwardly therein; and stop shoulders formed on said swing arms and limiting the inward motion thereof under the bias of said compression spring in cooperation with said cam groove; said pivot and said guide slot providing for inward and outward motions and up and down motions of said clamping holders.

9. In a machine for making bag-like two-compartment packages, the improvement claimed in claim 1, in which said raising arm having said tag receiving pocket is formed with a fold shoulder projecting longitudinally of the conveyance path; the other raising arm comprising a shaped piece having oblique shoulders and two controlled folders mounted for swinging toward each other in a swinging plane perpendicular to the swinging plane of said raising arms; each controlled folder having a folder shoe at its free end, for swinging of the folder shoes against each other; said folder shoes being operable to fold the border portions of a bag over the oblique shoulders of said shaped piece and over said fold shoulder, and being then movable against each other to form the V-shaped folding of the bag top so that the erected closed bag is clamped between said fold shoulder and said shaped piece.

10. In a machine for making bag-like two-compartment packages, the improvement claimed in claim 1, in which said device for further folding and finishing the top closure of the bag, and for fastening the thread to the bag, is mounted on a slewing arm swingable about the axis of a pivot carried by the respective common supporting frame and extending perpendicularly to the bag strip conveyance path so that said slewing arm is pivotable out of and into the conveyance path; a rotatable hub mounting said pivot for axial displacement but secured against rotation relative to said pivot; and means controlling said rotatable hub in accordance with the rhythm of said machine in a manner such that said slewing arm carrying said fastening device passes over the uprightly positioned bag while brushing and folding the top portion of the bag, projecting upwardly, and is subsequently lowered to apply the folded portion against the bag and fasten it thereto along with the thread.

11. In a machine for making bag-like two-compartment packages, the improvement claimed in claim 1, in which all those manufacturing mechanisms of each manufacturing unit having coordinatable motion components directed transversely to the conveyance path are mounted on a common supporting part; means mounting each common supporting part in the associated common supporting frame for movement transversely to the bag conveyance path; and means controlling the transverse movements of each common supporting part in accordance with the working rhythm of said machine.

12. In a machine for making bag-like two-compartment packages, the improvement claimed in claim 8, in which, after effecting top closure of the bag, said raising elements, along with the bag halves, are swung back into their initial position which is tangential to the conveyance path; and a controlled tongs mounted outside the path of conveyance operable, subsequent to such swinging back of said raising elements, to pick up the bag then folded over said fold shoulder of said raising element to remove the bag by displacement of said tongs.

* * * * *